US010427900B1

(12) United States Patent
Shiba

(10) Patent No.: US 10,427,900 B1
(45) Date of Patent: Oct. 1, 2019

(54) SHEET FEED APPARATUS AND IMAGE PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Tetsuo Shiba, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/928,476

(22) Filed: Mar. 22, 2018

(51) Int. Cl.
*B65H 7/14* (2006.01)
*G03G 15/00* (2006.01)

(52) U.S. Cl.
CPC ..... *B65H 7/14* (2013.01); *G03G 15/502* (2013.01); *G03G 15/6502* (2013.01); *B65H 2405/114* (2013.01); *B65H 2553/41* (2013.01); *B65H 2553/414* (2013.01); *B65H 2553/416* (2013.01)

(58) Field of Classification Search
CPC ..... B65H 2405/112; B65H 2405/1122; B65H 2405/1124; B65H 1/18; B65H 3/0684; B65H 2405/114; B65H 2405/1142; B65H 2405/11425; B65H 2405/1144; B65H 2553/41; B65H 2553/412; B65H 2553/414; B65H 2553/416; B65H 7/14; B65H 2511/152
USPC ..... 271/171
See application file for complete search history.

(56) References Cited

U.S. PATENT DOCUMENTS

| | | | | |
|---|---|---|---|---|
| 6,182,962 | B1 * | 2/2001 | Leuthold | B65H 1/24 271/126 |
| 7,885,597 | B2 * | 2/2011 | Gast | H04N 1/00567 271/162 |
| 8,336,870 | B2 * | 12/2012 | Kobayashi | B65H 1/14 271/10.01 |
| 8,894,063 | B2 * | 11/2014 | Araaki | B65H 1/266 271/145 |
| 9,376,276 | B2 * | 6/2016 | Yokoya | B65H 1/266 |
| 9,733,605 | B2 * | 8/2017 | Matos | B65H 31/02 |
| 2006/0255531 | A1 * | 11/2006 | Azzopardi | B65H 1/04 271/171 |
| 2014/0008864 | A1 * | 1/2014 | Kuo | B65H 1/00 271/145 |

FOREIGN PATENT DOCUMENTS

| | | |
|---|---|---|
| JP | 2007091440 A | 4/2007 |
| JP | 2016160096 A | 9/2016 |

* cited by examiner

*Primary Examiner* — Jeremy R Severson
(74) *Attorney, Agent, or Firm* — Kim & Stewart LLP

(57) ABSTRACT

A sheet feed apparatus comprises a tray, a pair of first guide sections, and a first optical sensor. The tray has a housing section for accommodating a plurality of sheets. The pair of first guide sections, arranged in the tray, sandwich the sheets in a direction perpendicular to a sheet conveyance direction. The first optical sensor provided above a bottom of the housing section in at least one of the first guide sections, is configured to detect one or more of uppermost sheets accommodated in the housing section.

19 Claims, 14 Drawing Sheets

SHEET FEED APPARATUS AND IMAGE PROCESSING APPARATUS

FIELD

Embodiments described herein relate generally to a sheet feed apparatus and an image processing apparatus.

BACKGROUND

A conventional image processing apparatus has a sheet feed apparatus in which a housing section configured to accommodate sheets is formed. For example, in the housing section of the sheet feed apparatus, a plurality of the sheets may be stacked in an overlapped manner. The sheet feed apparatus is detachably attached to a main body of the image processing apparatus. When the sheet feed apparatus is attached to the main body, a pickup roller comes into contact with the upper surface of the uppermost sheet accommodated in the sheet feed apparatus.

When the image processing apparatus starts printing, the pickup roller rotates to feed the sheet to a downstream side of a sheet conveyance direction.

Generally, the sheet is flat, and the number of the sheets which the sheet feed apparatus can accommodate is predetermined. In a case in which the sheet is curved (e.g., curled), or the number of the sheets in the sheet feed apparatus exceeds the maximum capacity, at the time the sheet is conveyed from the sheet feed apparatus to the downstream side of the sheet conveyance direction, the sheet may be jammed in the sheet conveyance path in some cases.

DETAILED DESCRIPTION

In accordance with an embodiment, a sheet feed apparatus comprises a tray, a pair of first guide sections, and a first optical sensor. The tray has a housing section for accommodating a plurality of sheets. The pair of first guide sections, arranged in the tray, sandwich the sheets in a direction perpendicular to a sheet conveyance direction. The first optical sensor provided above a bottom of the housing section in at least one of the first guide sections, is configured to detect one or more of uppermost sheets accommodated in the housing section.

Hereinafter, an image processing apparatus of an embodiment is described with reference to the accompanying drawings.

Figure 1:
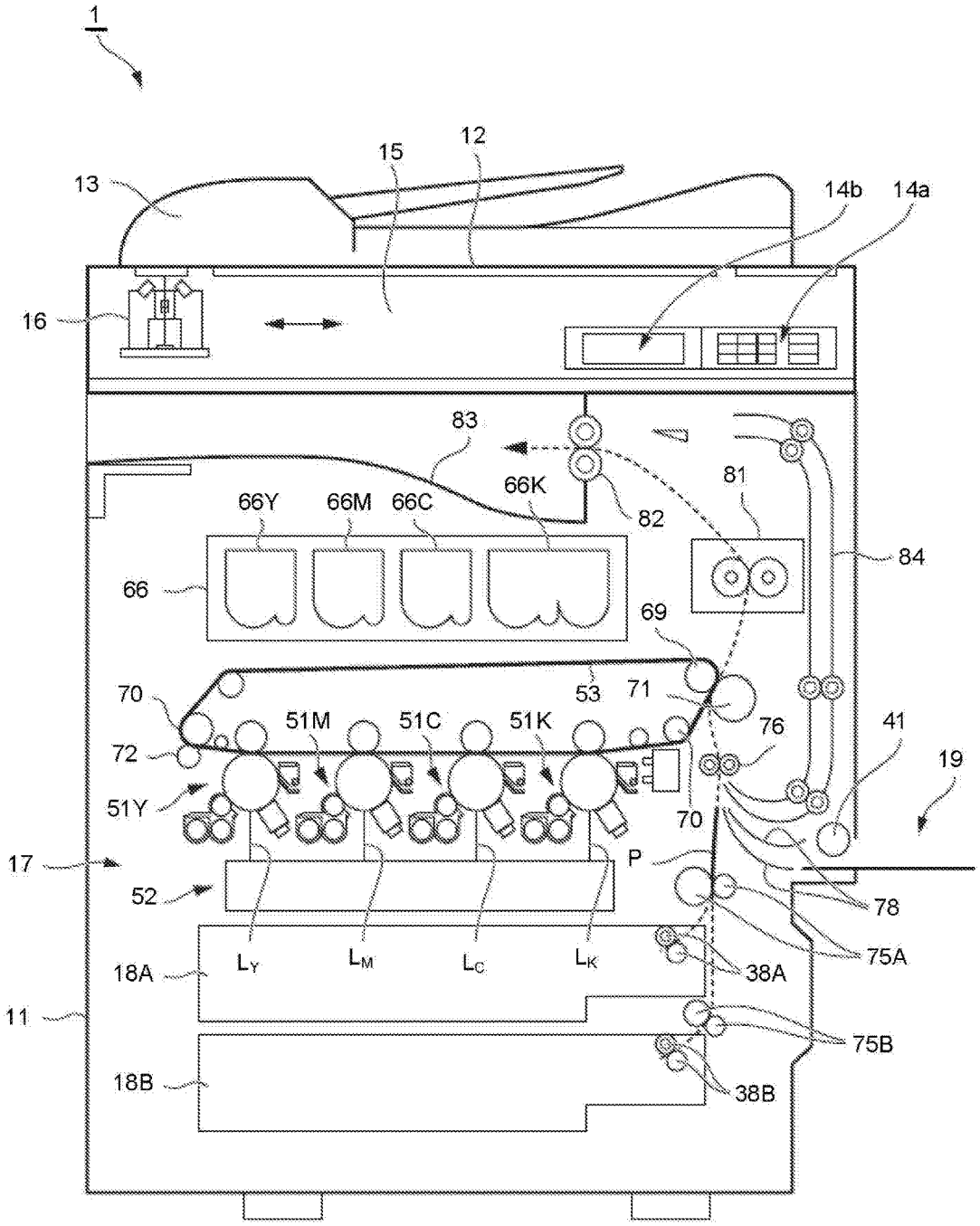
FIG. 1 is a schematic cross-sectional view illustrating a front view of an image processing apparatus according to an embodiment.

As shown in FIG. 1, an image processing apparatus 1 of the present embodiment is, for example, an MFP (Multi-Function Peripherals), a printer, a copying machine, or the like. An example in which the image processing apparatus 1 is an MFP is described below.

The image processing apparatus 1 has a main body 11. At the top of the main body 11, a document table 12 including a transparent glass is provided. An automatic document feeder (ADF) 13 is provided on the document table 12. At the top of the main body 11, an operation section 14*a* and a display section 14*b* are provided. The operation section 14*a* is, for example, an operation panel including various keys to receive operation input by a user. The display section 14*b* is, for example, a liquid crystal display panel. The display section 14*b* can display letters and the like.

A scanner section 15 is provided below the transparent glass of the document table 12. The scanner section 15 reads an image on an original document fed by the ADF 13 or an original document placed on the document table 12. The scanner section 15 generates image data of the original document by scanning a surface of the original document. The scanner section 15 includes, for example, an image sensor 16, which may be a contact type image sensor.

The image sensor 16 moves relative to the surface of the document table 12 at the time of reading the image on the original document placed on the document table 12. The image sensor 16 reads an original document line by line for one page of the document image.

When reading the image of the original document fed by the ADF 13, the image sensor 16 reads the fed original document at a fixed position shown in FIG. 1.

The main body 11 has a transfer section 17 at a center in a height direction thereof. The main body 11 has sheet feed cassettes 18A and 18B of the present embodiment and a manual sheet feed unit 19 at the bottom thereof.

In the present embodiment, the sheet feed cassette 18A and the sheet feed cassette 18B have the same configuration. In addition, image forming sections 51Y, 51M, 51C and 51K have the same configuration.

Figure 2:
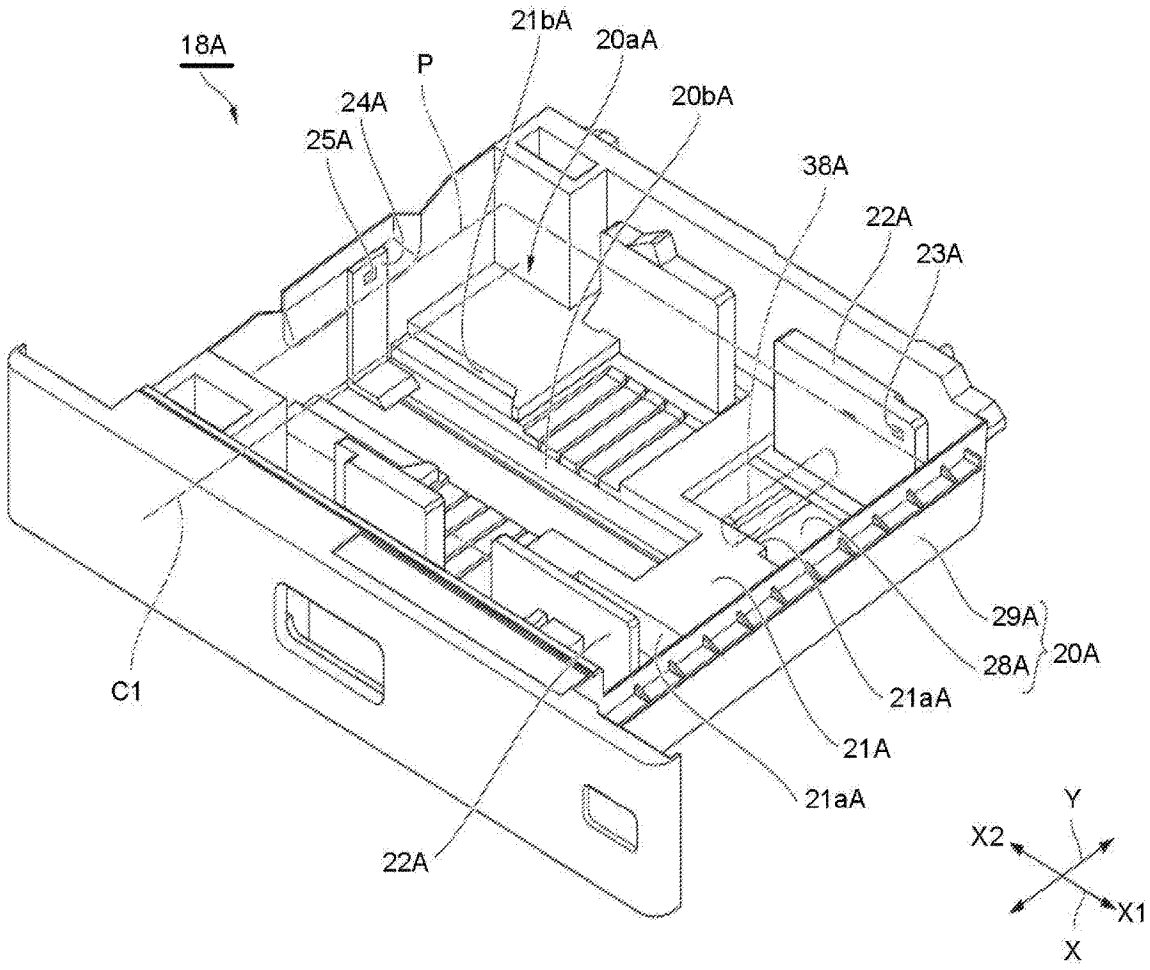
FIG. 2 is a perspective view of a sheet feed cassette of the image processing apparatus according to the embodiment.

The sheet feed cassette 18A shown in FIG. 2 is detachably attached to the main body 11. The sheet feed cassette 18A includes a cassette tray 20A, a tray sheet metal 21A, a pair of side guides 22A, a side optical sensor 23A, an end guide 24A, and an end optical sensor 25A.

The cassette tray 20A has a bottom wall 28A and a side wall 29A. The bottom wall 28A is formed in a rectangular shape in a plan view of the bottom wall 28A. The bottom wall 28A has an outer edge parallel to a sheet feeding direction X1 of the sheet P and an outer edge parallel to a direction Y perpendicular to the sheet feeding direction X1. In FIG. 2, the sheet P is shown by a two-dot chain line. The direction Y is a direction perpendicular to the sheet feeding direction X1 and a thickness direction of the sheet P stacked on an upper surface of the tray sheet metal 21A, respectively.

The side wall 29A extends upwardly from each outer edge of the bottom wall 28A. The cassette tray 20A includes a housing section 20*a*A for accommodating the plurality of the sheets P. The number of sheets P accommodated in the housing section 20*a*A can be one.

The tray sheet metal 21A is formed into a plate shape with metal or the like. The tray sheet metal 21A is arranged in the housing section 20*a*A of the cassette tray 20A. At an end of the downstream side in the sheet feeding direction X1 of the tray sheet metal 21A, a pair of through holes 21*a*A for avoiding interference with the pair of the side guides 22A is formed. The pair of the through holes 21*a*A is spaced from each other in the direction Y. Around an upstream side end of the tray sheet metal 21A in the sheet feeding direction X1, a notch 21*b*A for avoiding interference with an end guide 24A is formed. Although not shown, a rotation shaft extending in the direction Y is provided at the upstream side end of the tray sheet metal 21A in the sheet feeding direction X1. The rotation shaft of the tray sheet metal 21A is engaged with a bearing provided in the bottom wall 28A of the cassette tray 20A. The tray sheet metal 21A is rotatable about an axis C1 extending in the direction Y with respect to the cassette tray 20A. As the tray sheet metal 21A rotates around the axis C1, the height of the downstream side end of the tray sheet metal 21A in the sheet feeding direction X1 can change with respect to the cassette tray 20A. A plurality of the sheets P is stacked on an upper surface of the tray sheet metal 21A.

A gear (not shown) is connected to the tray sheet metal 21A. If the gear is driven, the height of the downstream side end of the tray sheet metal 21A in the sheet feeding direction X1 changes with respect to the cassette tray 20A.

Figure 3:
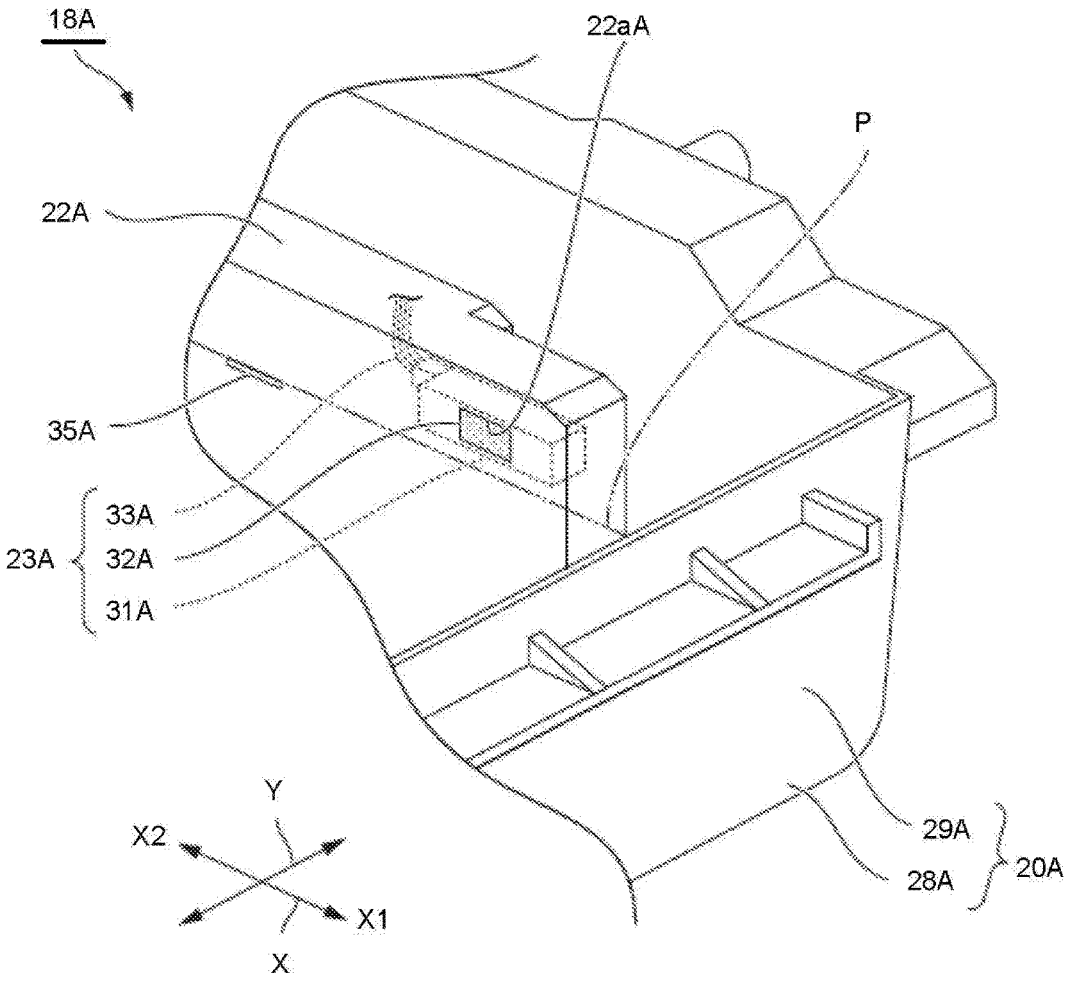
FIG. 3 is an enlarged view of the periphery of a side guide shown in FIG. 2.

As shown in FIG. 2 and FIG. 3, the side guide 22A is formed into a wall shape having a wall surface orthogonal to the direction Y. The pair of side guides 22A is provided in the cassette tray 20A. Each of the side guides 22A is movable in the direction Y with respect to a rail (not shown) provided on the bottom wall 28A of the cassette tray 20A. The side guide 22A is movable in the direction Y within the through hole 21*a*A of the tray sheet metal 21A.

A window hole 22*a*A is formed in the side guide 22A. The pair of the side guides 22A is arranged so as to sandwich the side edge of the plurality of the sheets P in the direction Y. The pair of the side guides 22A can sandwich the side edges of the sheets P of various sizes. In the sheets P of various sizes, a central axis thereof in the direction Y is aligned to a fixed position.

As shown in FIG. 3, the side optical sensor 23A is incorporated in the side guide 22A. For example, the side optical sensor 23A is a reflective sensor (e.g., diffusion reflective sensor) having a light projecting section 31A, a light receiving section 32A, and wiring 33A. The light projecting section 31A emits light. The light receiving section 32A detects light, e.g., the emitted light reflected by the sheet P. The side optical sensor 23A is fixed to the side guide 22A in such a manner that the light projecting section 31A and the light receiving section 32A are exposed to the outside from the window hole 22*a*A formed on a side surface of the side guide 22A.

As shown in FIG. 2, the side optical sensor 23A is arranged above a bottom surface 20*b*A of the housing section 20*a*A in the side guide 22A. The side optical sensor 23A is preferably provided at the downstream side end of the side guide 22A in the sheet feeding direction X1.

A wiring 33A of the side optical sensor 23A is connected to a sheet feed and conveyance control circuit 97 described later.

In this example, the side optical sensor 23A is provided in each of the pair of the side guides 22A. As a modification, the side optical sensor 23A may be provided on only one of the pair of the side guides 22A.

As shown in FIG. 3, for example, in the side guide 22A, an indicator 35A indicating the maximum height of the top surface of the stacked sheet that can be accommodated in the housing section 20*a*A of the cassette tray 20A, is attached to a part of the upstream side of the side guide 22A in the sheet feeding direction X1 with respect to the window hole 22*a*A. The indicator 35A is arranged below the light projecting section 31A and the light receiving section 32A of the side optical sensor 23A. When the uppermost sheet P among the plurality of the sheets P accommodated in the housing section 20*a*A and the indicator 35A are at a same height in the vertical direction, the height of the plurality of the sheets P stacked in the housing section 20*a*A is at the maximum height. The maximum height of the plurality of the sheets P is determined to prevent the sheets from being jammed in a conveyance path of the image processing apparatus 1.

The side guide 22A is preferably provided with a side auxiliary optical sensor for detecting a vertical position (height) of the upper surface of the plurality of the sheets P.

Figure 4:
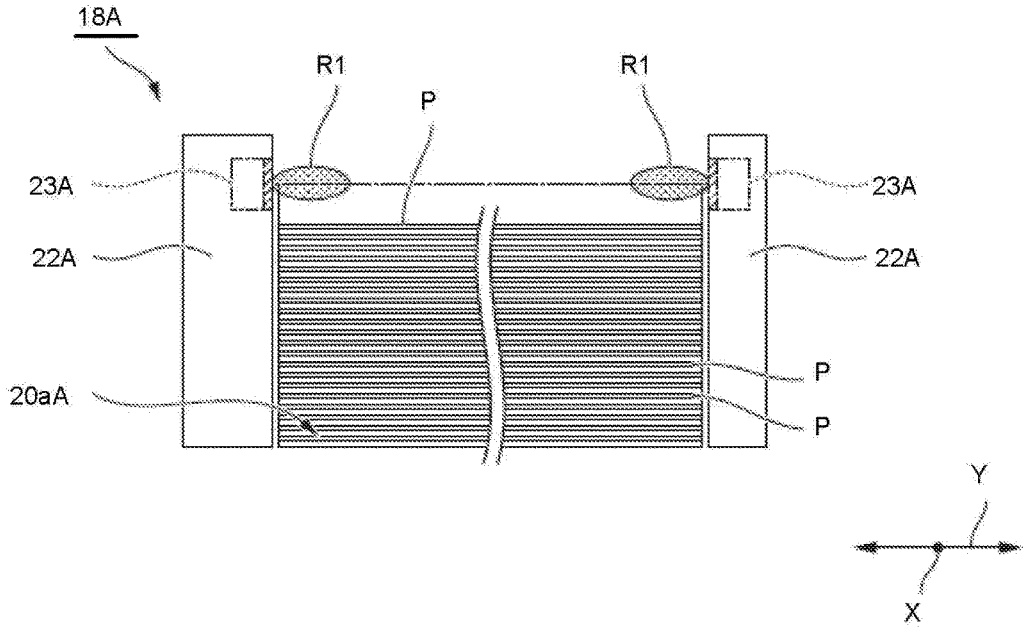
FIG. 4 is a side view of the side guide, a side optical sensor and a plurality of flat sheets in the sheet feed cassette of the image processing apparatus according to the embodiment.

A detectable area R1 where the side optical sensor 23A can detect the sheet P is shown in FIG. 4. When the plurality of flat sheets P is stacked in the housing section 20*a*A at the maximum height or less, the upper surface of the uppermost sheet of the stacked sheets P is positioned below the detectable area R1 of the side optical sensor 23A. For this reason, the side optical sensor 23A does not detect the plurality of the sheets P.

Furthermore, an overloading state of the sheets P in which the plurality of flat sheets P with the height higher than the maximum height is stacked in the housing section 20*a*A is shown by a two-dotted chain line in FIG. 4. The plural sheets P positioned at uppermost portion of the stacked sheets are within the detectable area R1 of the side optical sensor 23A in the overloading state when the sheets P with the number thereof larger than a maximum allowable number of sheets are accommodated in the housing section 20*a*A. As a result, in such overloading state, the side optical sensor 23A detects the plurality of the sheets P.

Figure 5:
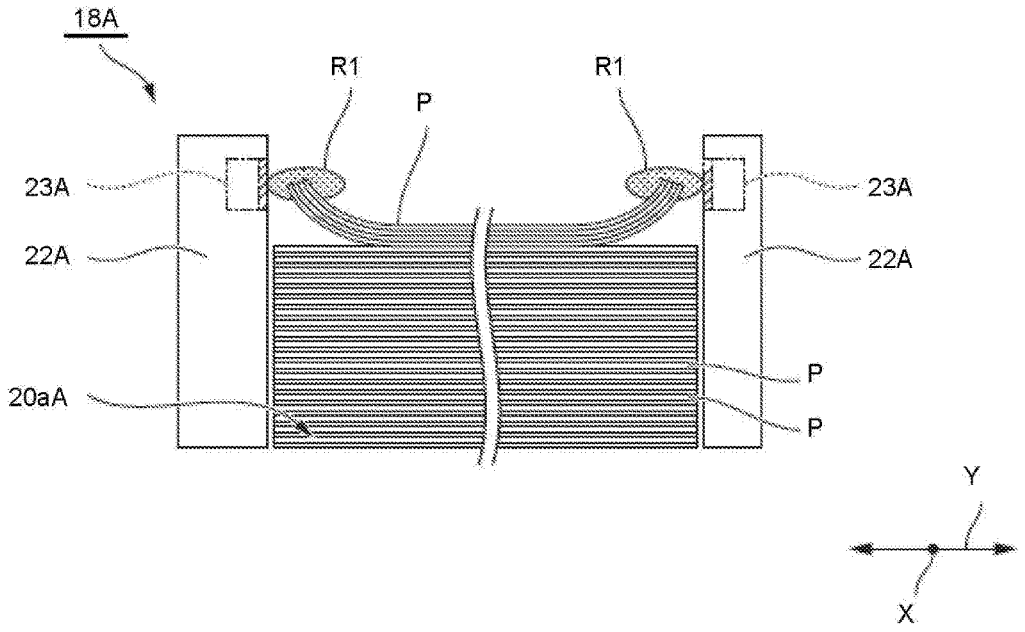
FIG. 5 is a side view of the side guide, the side optical sensor, and a plurality of curved sheets in the sheet feed cassette of the image processing apparatus according to the embodiment.

On the other hand, in FIG. 5, if the plurality of the sheets P is curled to be convex downward in a vertical plane direction including the direction Y, both ends of the plurality of the sheets P in the direction Y can be within the detectable area R1 of the side optical sensor 23A because of the curl, even when the number of the sheets actually stacked is less than the maximum allowable number of sheets.

Figure 6:
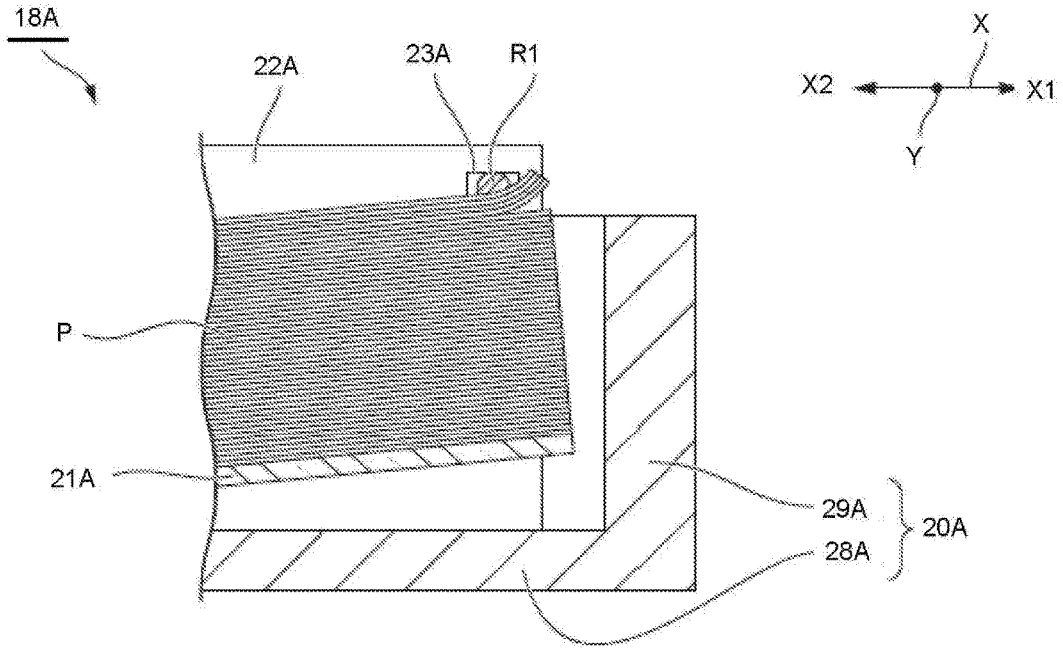
FIG. 6 is a sectional view illustrating a front view of the side guide, the side optical sensor, and the plurality of curved sheets in the sheet feed cassette of the image processing apparatus according to the embodiment.

The plurality of the sheets P shown in FIG. 6 is curled to be curved downward. Furthermore, in FIG. 6, the downstream side end of the tray sheet metal 21A in the sheet feeding direction X1 rises. At this time, the downstream side ends of the plurality of the sheets P in the sheet feeding direction X1 are positioned within the detectable area R1 of the side optical sensor 23A. Therefore, in the situation of FIG. 6, the side optical sensor 23A detects the plurality of the sheets P.

As described above, the side optical sensor 23A can detect an accommodation state of the plurality of the sheets P such as the curling and overloading of the plurality of the sheets P.

Figure 7:
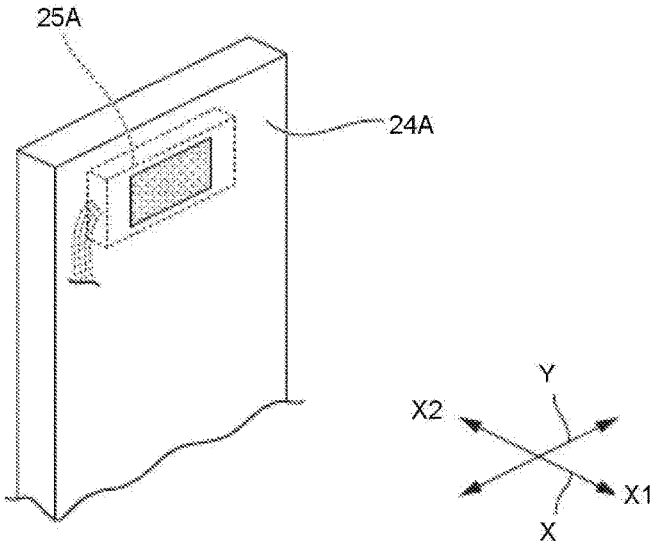
FIG. 7 is an enlarged view illustrating the periphery of an end guide shown in FIG. 2.

As shown in FIG. 7, the end guide 24A is formed into a wall shape parallel with the vertical plane parallel to the direction Y so as to regulate the upstream side edge of the sheets in the sheet feeding direction X1. The end guide 24A is provided in the cassette tray 20A. The end guide 24A is slidable in the sheet feeding direction X1 with respect to a rail (not shown) provided in the bottom wall 28A of the cassette tray 20A. The end guide 24A is slidable in the sheet feeding direction X1 within the notch 21*b*A of the tray sheet metal 21A. The end guide 24A is located at center part of the bottom wall 28A of the cassette tray 20A in the direction Y.

The end optical sensor 25A is constituted similarly to the side optical sensor 23A. The end optical sensor 25A is arranged to be integrated in the end guide 24A. As shown in FIG. 2, the end optical sensor 25A detects the center in the direction Y, of the upstream side ends of the plurality of the sheets P in the sheet feeding direction X1.

If the plurality of the sheets P is curled, the end optical sensor 25A detects the rising portion of the plurality of the sheets P because of the curl.

The sheet feed cassette 18A has a sheet feed side connector (not shown). The wiring 33A and the like of the optical sensors 23A and 25A are electrically connected to the sheet feed side connector.

As shown in FIG. 1, the sheet feed cassettes 18A and 18B are arranged in the vertical direction such that their footprints overlap when viewed from the vertical direction.

The manual sheet feed unit 19 protrudes from the side surface or the main body 11 below an inversion conveyance path 84, which is described later.

As shown in FIG. 1 and FIG. 2, the main body 11 has pickup rollers 38A and 38B. The pickup roller 38A is formed in a columnar shape having an axis parallel with the direction Y. The width of the pickup roller 38A in the direction Y is shorter than that of the sheet P stacked in the sheet feed cassette 18A. The pickup roller 38A is rotatable around a rotational axis parallel with the direction Y. The pickup roller 38A is connected to a roller moving section 39A (refer to FIG. 8) having a link mechanism, a roller driving motor and the like. By driving the roller driving motor of the roller moving section 39A, the roller moving section 39A moves the pickup roller 38A between a state in which the pickup roller 38A comes into contact with the top surface of the stacked sheets and a state in which the pickup roller 38A separates from the top surface of the stacked sheets. The pickup roller 38A picks up the sheets P one by one from the sheet feed cassette 18A and feeds them to the conveyance path of the sheet P.

As shown in FIG. 1, the manual sheet feed unit 19 has a manual sheet feed mechanism 41. The manual sheet feed mechanism 41 picks up the sheets P one by one from the manual sheet feed unit 19 and feeds them to the conveyance path.

The transfer section 17 forms an image on the sheet P based on image data read by the scanner section 15 or image data received from an external device through a network. The transfer section 17 is a color printer of a tandem system.

As shown in FIG. 1, the transfer section 17 includes image forming sections 51Y, 51M, 51C and 51K of yellow (Y), magenta (M), cyan (C), and black (K) colors, an exposure device 52, and an intermediate transfer belt 53. In the present embodiment, the transfer section 17 has four image forming sections 51Y, 51M, 51C and 51K. The transfer section 17 has so-called quadruple image forming sections.

The configuration of the transfer section 17 is not limited thereto, and the transfer section may include two or three image forming sections, or the transfer section may include five or more image forming sections.

The image forming sections 51Y, 51M, 51C and 51K are arranged below the intermediate transfer belt 53. The image forming sections 51Y, 51M, 51C and 51K are arranged along the a moving direction (a direction from the left side to the right side in FIG. 1) of the lower outer peripheral surface of the intermediate transfer belt 53.

The exposure device 52 irradiates exposure light $L_Y$, $L_M$, $L_C$ and $L_K$ to the image forming sections 51Y, 51M, 51C and 51K, respectively. The exposure device 52 may be constituted to generate a laser scanning beam as the exposure light. The exposure device 52 may include a solid-state scanning element such as an LED (Light Emitting Diode) for generating the exposure light.

The configurations of the image forming sections 51Y, 51M, 51C and 51K are the same except that the colors of the toner are different. Either one of a normal color toner and a decolorable toner may be used as the toner for each image forming section. The decolorable toner becomes transparent if heated at a certain temperature or higher. The image processing apparatus 1 may be the image processing apparatus that can use the decolorable toner or the image processing apparatus that cannot use the decolorable toner. The image processing apparatus 1 may be a decoloring apparatus for decoloring the image formed with the decolorable toner.

Hereinafter, the configuration shared by the image forming sections 51Y, 51M, 51C and 51K is described by using the image forming section 51K as an example.

Figure 9:
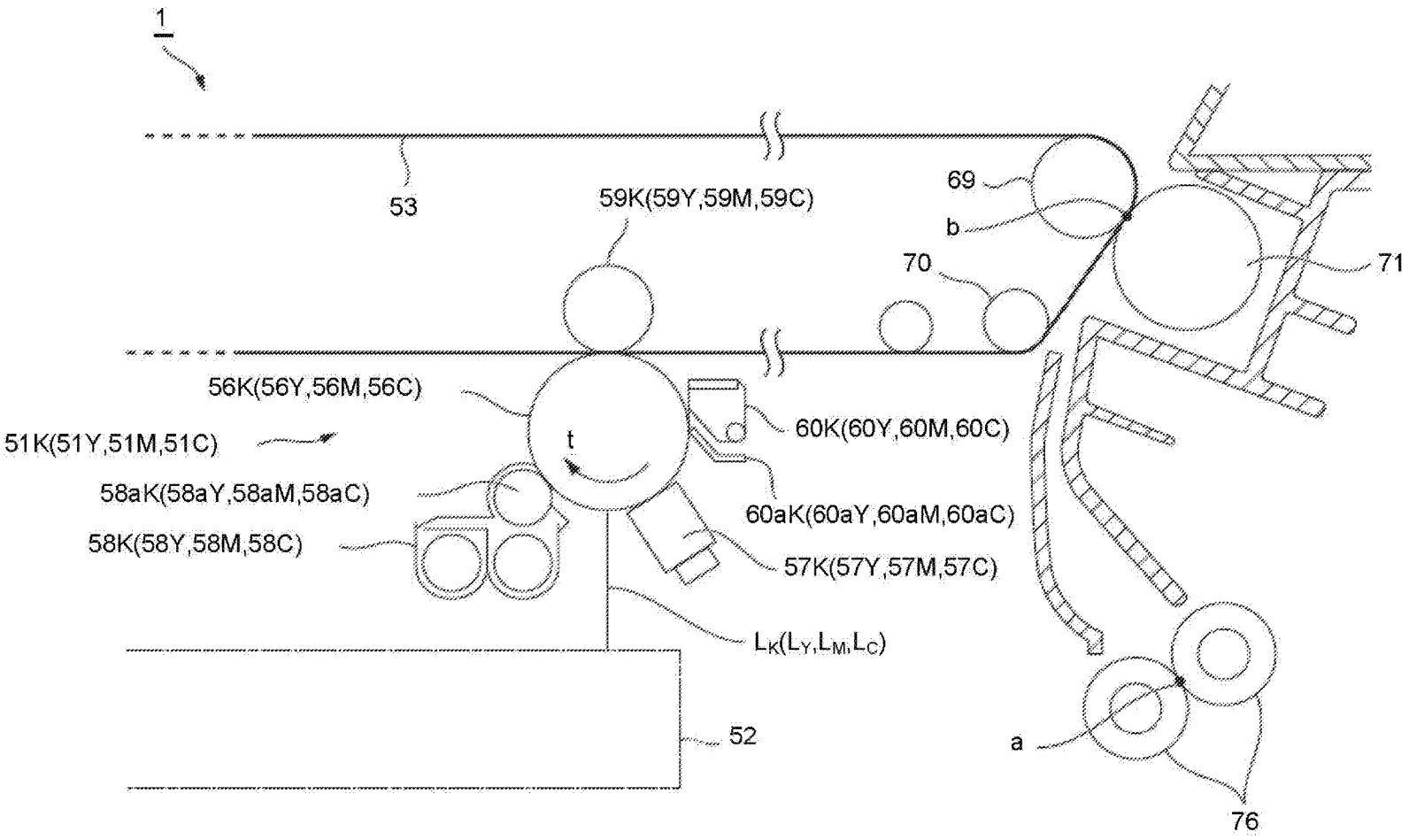
FIG. 9 is a schematic view illustrating the periphery of an image forming section in FIG. 1.

As shown in FIG. 9, the image forming section 51K has a photoconductive drum 56K. The photoconductive drum 56K rotates in a rotation direction t. A charging device 57K, a developing device 58K, a primary transfer roller 59K and a cleaner 60K are arranged around the photoconductive drum 56K along the rotation direction t shown in FIG. 9.

The charging device 57K of the image forming section 51K uniformly charges the outer circumferential surface of the photoconductive drum 56K.

The exposure device 52 generates the exposure light $L_K$ modulated based on the image data. The exposure light $L_K$ exposes the surface of the photoconductive drum 56K. The exposure device 52 forms an electrostatic latent image on the photoconductive drum 56K.

The developing device 58K supplies black toner to the photoconductive drum 56K by a developing roller 58*a* to which a developing bias is applied. The developing device 58K develops the electrostatic latent image on the photoconductive drum 56K with the black toner.

The cleaner 60K has a blade 60*a*K abutting against the photoconductive drum 56K. The blade 60*a*K removes residual toner on the surface of the photoconductive drum 56K.

The image forming sections 51Y, 51M and 51C have developing devices 58Y, 58M, and 58C different only in the toner color from the developing device 58K of the image forming section 51K.

As shown in FIG. 1, at the top of the image forming sections 51Y, 51M, 51C and 51K, a supply section 66 is arranged.

The supply section 66 supplies the toner to the developing devices 58Y, 58M, 58C and 58K, respectively. The supply section 66 has toner cartridges 66Y, 66M, 66C and 66K. The toner cartridges 66Y, 66M, 66C, and 66K store a yellow toner, a magenta toner, a cyan toner, and a black toner, respectively.

In each of the toner cartridges 66Y, 66M, 66C, and 66K, a marking part (not shown) is provided which is used for the main body 11 to detect the type of the toner stored therein. The marking part includes at least information on the colors of the toner in the toner cartridges 66Y, 66M, 66C and 66K and information for identifying whether the toner is the normal toner or the decolorable toner.

The intermediate transfer belt 53 moves cyclically. The intermediate transfer belt 53 has an endless belt shape and is wrapped around a driving roller 69 and a plurality of driven rollers 70.

As shown in FIG. 9, the intermediate transfer belt 53 is in contact with the outer circumferential surface of the photoconductive drums 56Y, 56M, 56C and 56K from the above.

At a position above the photoconductive drum 56K and opposite to the photoconductive drum 56K across the intermediate transfer belt 53, the primary transfer roller 59K is arranged. The primary transfer roller 59K is arranged inside the intermediate transfer belt 53 so that the intermediate transfer belt 53 is sandwiched between the photoconductive drum 56K and the primary transfer roller 59K.

If a primary transfer voltage is applied, the primary transfer roller 59K transfers the toner image on the photoconductive drum 56K onto the intermediate transfer belt 53 to perform a primary transfer.

A secondary transfer roller 71 is opposed to the driving roller 69 across the intermediate transfer belt 53. The abutment portion between the intermediate transfer belt 53 and the secondary transfer roller 71 constitutes a secondary transfer position b. The driving roller 69 rotationally drives the intermediate transfer belt 53.

A secondary transfer voltage is applied to the secondary transfer roller 71 at the time the sheet P passes through the secondary transfer position b. If a secondary transfer voltage is applied to the secondary transfer roller 71, the secondary transfer roller 71 transfers the toner image on the intermediate transfer belt 53 onto the sheet P to perform a secondary transfer.

As shown in FIG. 1, a belt cleaner 72 is arranged at a position facing one of a plurality of the driven rollers 70 across the intermediate transfer belt 53. The belt cleaner removes the residual transferred toner on the outer circumferential surface of the intermediate transfer belt 53 from the intermediate transfer belt 53.

A sheet feed roller 75A and a registration roller 76 are arranged along the conveyance path from the sheet feed cassette 18A to the secondary transfer roller 71. The sheet feed roller 75A conveys the sheet P taken out from the inside of the sheet feed cassette 18A by the pickup roller 38A.

The registration roller 76 aligns the position of the tip of the sheet P fed from the sheet feed roller 75A at a mutual contact position thereof. The mutual contact position in the registration roller 76 (refer to a point a in FIG. 9) constitutes a registration position. When the front side tip of the toner image reaches the secondary transfer position b, the registration roller 76 conveys the sheet P such that the front side tip of an area on the sheet P, onto which the toner image is transferred, reaches the secondary transfer position b.

As shown in FIG. 1, a sheet feed roller 75B is arranged along the conveyance path from the sheet feed cassette 18B to the sheet feed roller 75A. The sheet feed roller 75B conveys the sheet P taken out from the sheet feed cassette 18B by the pickup roller 38B towards the sheet feed roller 75A.

The conveyance path is formed by a conveyance guide 78 between the manual sheet feed mechanism 41 and the registration roller 76. The manual sheet feed mechanism 41 feeds the sheet P taken out from the manual sheet feed unit 19 towards the conveyance guide 78. The sheet P moving along the conveyance guide 78 reaches the registration roller 76.

At the downstream side (upper side in the figure) of the secondary transfer roller 71 in the sheet feeding direction, a fixing section 81 is arranged. Although not shown, the fixing section 81 has a halogen lamp and a driving motor for conveying the sheet P. The fixing section 81 fixes the toner image on the sheet P by heating the sheet P with the halogen lamp.

A conveyance roller 82 is arranged at the downstream side (upper left side in the figure) of the fixing section 81 in the sheet feeding direction. The conveyance roller 82 discharges the sheet P to a sheet discharge section 83.

The inversion conveyance path 84 is arranged at the downstream side (right side in FIG. 1 when viewed from front side) of the fixing section 81 in the sheet feeding direction. The inversion conveyance path 84 reverses the sheet P to guide it to the secondary transfer roller 71. The inversion conveyance path 84 can be used for duplex printing.

The constitution of a controller 91 of the image processing apparatus 1 is described.

Figure 8:
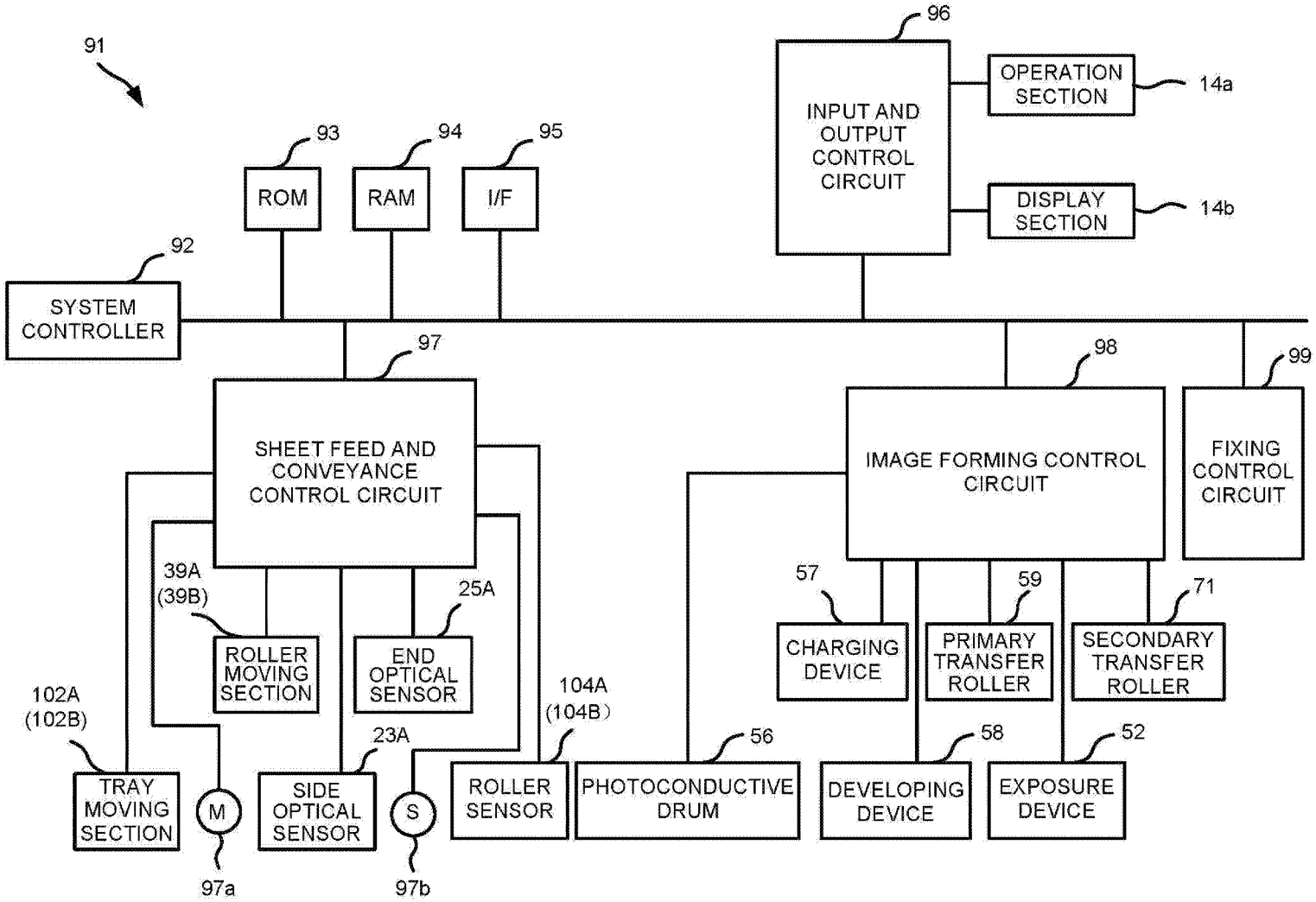
FIG. 8 is a block diagram illustrating components of a controller of the image processing apparatus according to the embodiment.

FIG. 8 is a block diagram exemplifying the constitution of the controller 91 of the image processing apparatus 1. However, in FIG. 8, for ease of view, the members distinguished by the subscripts Y, M, C, and K are represented collectively by reference numerals from which these subscripts are deleted. For example, the photoconductive drum 56 represents the photoconductive drums 56Y, 56M, 56C and 56K. The charging device 57, the developing device 58, and the primary transfer roller 59 are also similar.

In the description with reference to FIG. 8, based on the description in FIG. 8, the reference numerals with the subscripts Y, M, C and K omitted are used in some cases.

The controller 91 includes a system controller 92, a read only memory (ROM) 93, a random access memory (RAM) 94, an interface (I/F) 95, an input and output control circuit 96, a sheet feed and conveyance control circuit 97, an image forming control circuit 98, and a fixing control circuit 99.

The system controller 92 controls the whole of the image processing apparatus 1. The system controller 92 realizes a processing function for image formation by executing a program stored in the ROM 93 or the RAM 94 described later. As the device constitution of the system controller 92, a processor such as a CPU (Central Processing Unit) or the like may be used.

The ROM 93 stores the control program, data for control, and the like that control the basic operation of the image forming processing.

The RAM 94 is a working memory in the controller 91. For example, in the RAM 94, a control program or control data in the ROM 93 is loaded as necessary. Furthermore, the RAM 94 temporarily stores the image data sent from the input and output control circuit 96 or the data sent from the system controller 92.

The I/F 95 communicates with a connection device connected to the main body 11. For example, the scanner section 15 is connected to the I/F 95 in a communicable manner. Furthermore, an external device can be connected to the I/F 95. As examples of the external device, a user terminal, a facsimile machine, and the like are exemplified.

The input and output control circuit 96 controls the operation section 14*a* and the display section 14*b*. The input and output control circuit 96 sends an operation input received from the operation section 14*a* to the system controller 92.

The sheet feed and conveyance control circuit 97 has a memory (not shown). A control program for controlling the sheet feed and conveyance control circuit 97, and values such as a predetermined first height threshold value, second height threshold value, and third height threshold value are stored in the memory.

The sheet feed and conveyance control circuit 97 controls a driving system included in the main body 11. For example, the driving system includes the sheet feed rollers 75A and 75B, the manual sheet feed mechanism 41, and a driving motor 97*a* configured to drive the registration roller 76. The sheet feed and conveyance control circuit 97 controls the roller moving sections 39A and 39B, and the tray moving sections 102A and 102B. The tray moving section 102A is a motor or the like. When the sheet feed cassette 18A is attached to the main body 11, the tray moving section 102A is connected to a gear of the sheet feed cassette 18A. At this time, if the tray moving section 102A is driven, the tray sheet metal 21A is moved upwardly by using the gear.

For example, the sheet feed and conveyance control circuit 97 is connected to the control side connector (not shown). When the sheet feed cassette 18A is attached to the main body 11, the control side connector and the sheet feed side connector are electrically connected, and the sheet feed and conveyance control circuit 97 is electrically connected to the optical sensors 23A and 25A.

A plurality of sensors 97*b*, the optical sensors 23A and 25A, and roller sensors 104A and 104B are electrically connected to the sheet feed and conveyance control circuit 97. For example, the plurality of sensors 97*b* includes a plurality of sheet detection sensors. The plurality of the sheet detection sensors is arranged inside the conveyance path and the manual sheet feed unit 19 in the main body 11. Each sheet detection sensor detects the presence or absence of the sheet P at the sensor arrangement position.

For example, the roller sensor 104A is a capacitive sensor. The roller sensor 104A detects the position of the pickup roller 38A in the vertical direction.

The detection results of the sensor 97*b*, the optical sensors 23A and 25A, and the roller sensors 104A and 104B are sent to the system controller 92 through the sheet feed and conveyance control circuit 97.

Based on the control signal from the system controller 92 and the detection results of the sensor 97*b*, the optical sensors 23A and 25A, and the roller sensors 104A and 104B, the sheet feed and conveyance control circuit 97 drives the driving motor 97*a*, the roller moving sections 39A and 39B, and the tray moving sections 102A and 102B.

Based on a control signal from the system controller 92, the image forming control circuit 98 controls the photoconductive drum 56, the charging device 57, the exposure device 52, the developing device 58, the primary transfer roller 59, the secondary transfer roller 71, respectively.

The fixing control circuit 99 controls the driving motor and the halogen lamp of the fixing section 81 respectively based on a control signal from the system controller 92.

The control performed by the controller 91 is described in detail together with the operation of the image processing apparatus 1.

Figure 10:
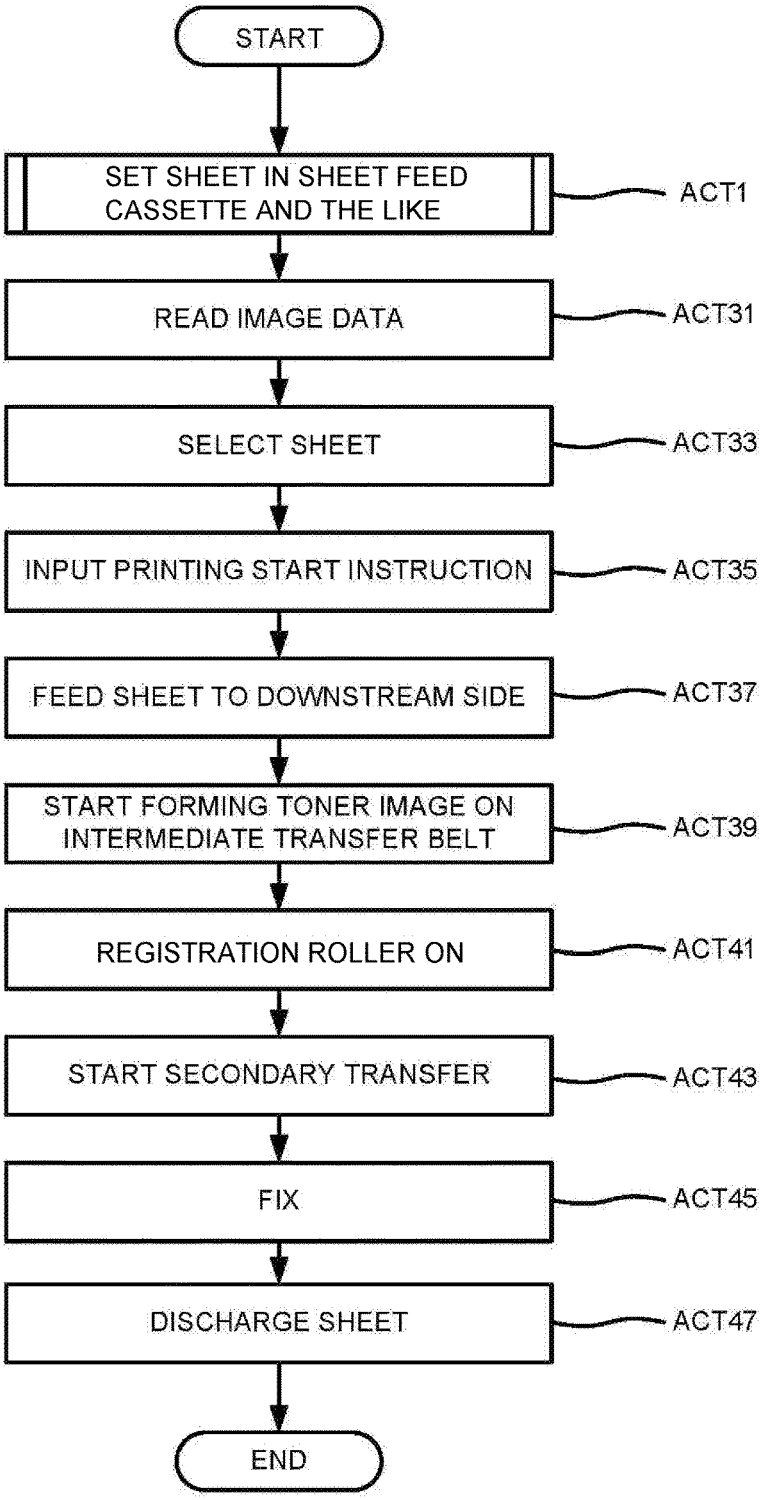
FIG. 10 is a flowchart depicting an example of the operation during printing by the image processing apparatus according to the embodiment.
Figure 11:
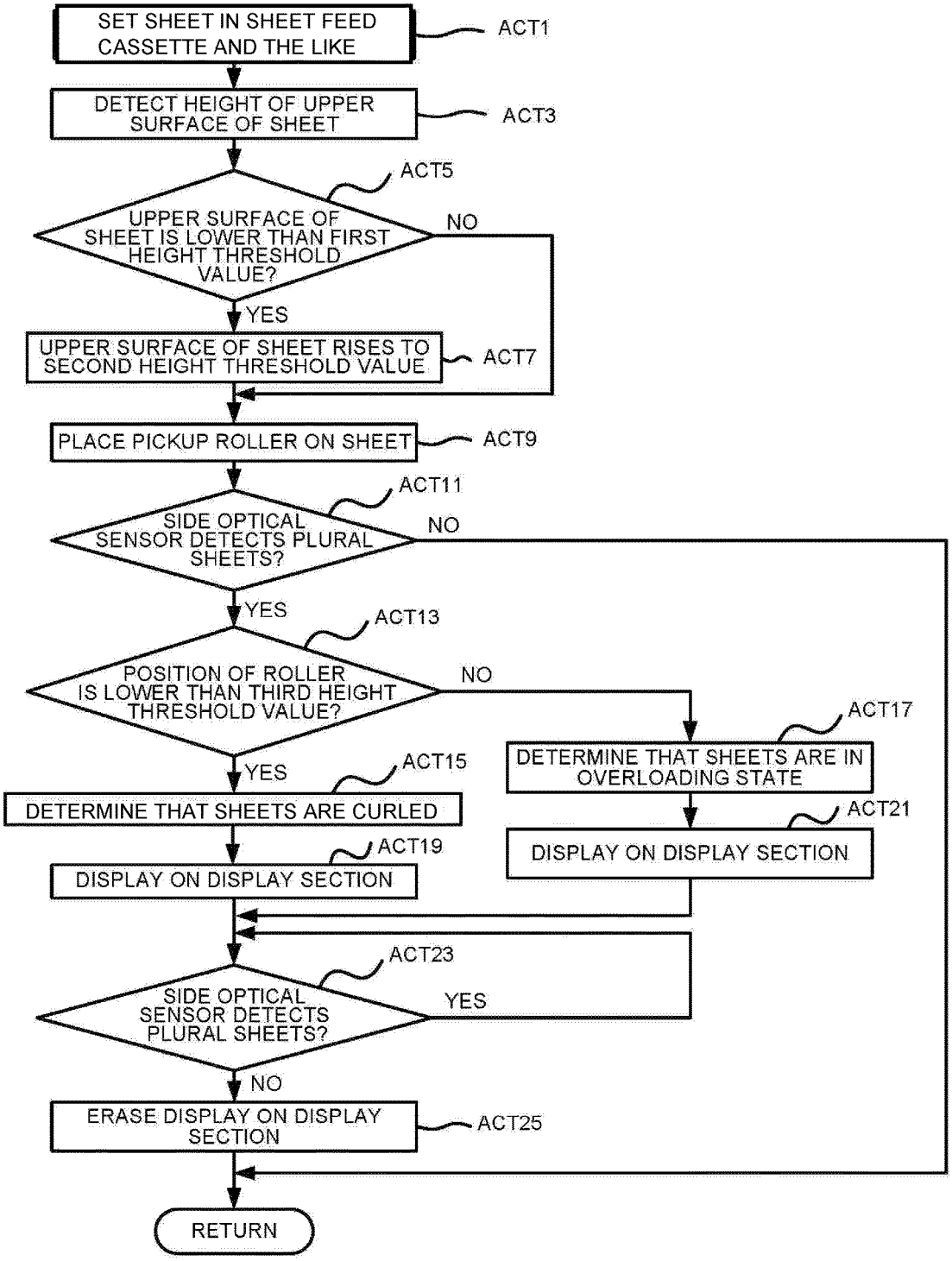
FIG. 11 is a flowchart depicting steps of subroutine for feeding a sheet to the sheet feed cassette in the flowchart of FIG. 10.

Next, the operation of the image processing apparatus 1 of the present embodiment constituted as described above is described. FIG. 10 and FIG. 11 are flowcharts exemplifying the operation of the image processing apparatus 1 at the time of printing according to the embodiment.

The image processing apparatus 1 forms an image on the sheet P by executing the processing in Act 1 to Act 47 shown in FIG. 10 and FIG. 11 according to the flows in FIG. 10 and FIG. 11.

In Act 1, an operator sets the sheet P in the sheet feed cassettes 18A and 18B and on the manual sheet feed unit 19. Hereinafter, the sheet feed to the sheet feed cassette 18A is described in detail. It is assumed that characters or the like are not displayed on the display section 14*b* beforehand. Characters or the like may not be displayed in advance in a warning display area which is a part of the display section 14*b*.

First, the operator detaches the sheet feed cassette 18A from the main body 11 of the image processing apparatus 1. The sheet feed side connector of the sheet feed cassette 18A is detached from the control side connector of the main body 11.

The positions of the pair of the side guides 22A and the end guide 24A are adjusted as necessary. There is a case in which the sheet P is curled if the sheet P is re-used many times, or if humidity of the outside air of the image processing apparatus 1 is relatively high.

The plurality of the sheets P is accommodated in the housing section 20*a*A of the sheet feed cassette 18A.

When the sheet feed cassette 18A is attached to the main body 11, the control side connector of the main body 11 and the sheet feed side connector of the sheet feed cassette 18A are connected.

In Act 3 shown in FIG. 11, the sheet feed and conveyance control circuit 97 determines the height of the upper surface of the plurality of the sheets P based on the detection result of the side auxiliary optical sensor and the like. If the processing in Act 3 is terminated, the processing in ACT 5 is executed.

Figure 12:
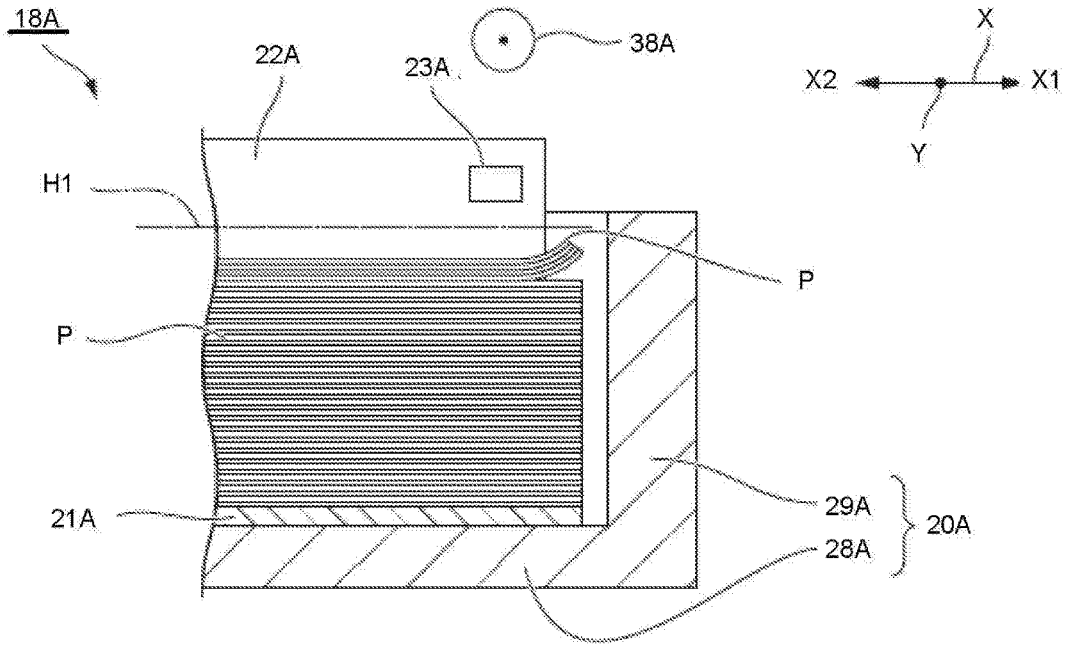
FIGS. 12-14 are each a schematic cross-sectional view illustrating a front view of the image processing apparatus according to the embodiment during operation.

As shown in FIG. 12, in ACT 5, the sheet feed and conveyance control circuit 97 determines whether or not the height of the upper surface of the uppermost sheet of the plurality of the sheets P is lower than a first height threshold value H1. In the example of FIG. 12, the plurality of the sheets P is not in the overloading state, but is curved to be convex downward in the sheet feeding direction X.

If the height of the upper surface of the uppermost sheet of the plurality of the sheets P is lower than the first height threshold value H1 (Yes in ACT 5), the processing in ACT 7 is executed. On the other hand, if the height of the upper surface of the uppermost sheet of the plurality of the sheets P is greater than or equal to the first height threshold value H1 (No in ACT 5), the processing in ACT 9 is executed. In the example of FIG. 12, the processing in ACT 7 is executed because the height of the upper surface of the plurality of the sheets P is lower than the first height threshold value H1.

Figure 13:
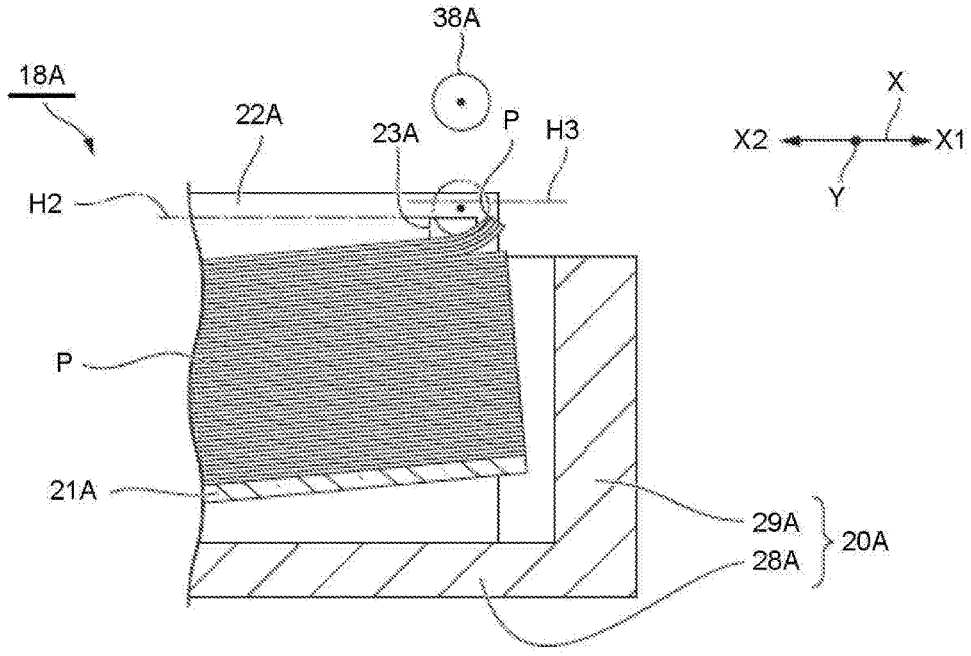

As shown in FIG. 13, in ACT 7, the sheet feed and conveyance control circuit 97 drives the tray moving section 102A to raise the tray sheet metal 21A so that the upper surface of the plurality of the sheets P is increased to a second height threshold value H2. In order to detect the height of the upper surface of the uppermost sheet of the plurality of the sheets P, the side optical sensor 23A is used. If the processing in ACT 7 is terminated, the processing in ACT 9 is executed.

In ACT 9, the sheet feed and conveyance control circuit 97 drives the roller moving section 39A to cause the pickup roller 38A to come into contact with the upper surface of the upper most surface of the plurality of the sheets P stacked in the housing section 20*a*A. The pickup roller 38A placed on the plural sheets P is indicated by a two-dot chain line shown in FIG. 13. Due to the weight of the pickup roller 38A applied onto the upper surface of the uppermost sheet, the plurality of the sheets P curved at the downstream side end in the sheet feeding direction X1 becomes flat. If the processing in ACT 9 is terminated, the processing in Act 11 is executed.

In Act 11, the sheet feed and conveyance control circuit 97 determines whether or not the side optical sensor 23A detects the plurality of the sheets P. If the side optical sensor 23A detects the plurality of the sheets P (Yes in Act 11), the processing in Act 13 is executed. On the other hand, if the side optical sensor 23A does not detect the plurality of the sheets P (No in Act 11), all steps in Act 1 are ended and the processing in Act 31 (refer to FIG. 10) is executed.

The processing in Act 11 may be executed using the end optical sensor 25A.

In Act 13, the sheet feed and conveyance control circuit 97 determines whether or not the roller sensor 104A detects that the position of the pickup roller 38A is lower than a third height threshold value H3. For example, the position of the pickup roller 38A mentioned here means the position of a central axis of the pickup roller 38A. If it is detected that the position of the pickup roller 38A is lower than the third height threshold value H3 (Yes in Act 13), the processing in Act 15 is executed. On the other hand, if the roller sensor 104A detects that the position of the pickup roller 38A is equal to or higher than the third height threshold value H3 (No in Act 13), the processing in Act 17 is executed.

In Act 15, the sheet feed and conveyance control circuit 97 determines that the plurality of the sheets is curled. If the processing in Act 15 is terminated, the processing in Act 19 is executed.

In Act 19, the sheet feed and conveyance control circuit 97 sends a control signal to the input and output control circuit 96 through the system controller 92. If the input and output control circuit 96 enables the display section 14*b* to perform the display, a message "The sheet is curled. Please correct." is displayed in the warning display area of the display section 14*b*. If the processing in Act 19 is terminated, the processing in Act 23 is executed.

The display section 14*b* may be provided with an LED, and the LED may be lit if the display section 14*b* performs the display.

Figure 14:
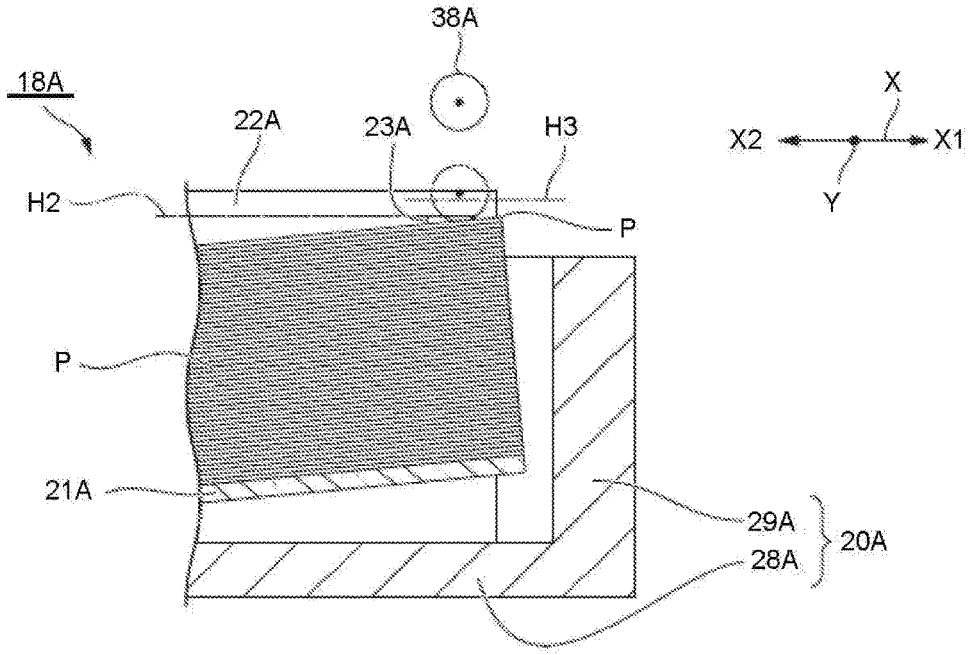

As shown in FIG. 14, if the position of the pickup roller 38A is equal to or higher than the third height threshold value H3, for example, the plurality of the sheets P is in the overloading state. In this case, even if the pickup roller 38A applies its own weight on the downstream side end of the upper surface of the uppermost sheet of the plurality of the sheets P in the sheet feeding direction X1, the weight of the pickup roller will barely cause the plurality of the sheets P to be pressed down sufficiently. In Act 17, the sheet feed and conveyance control circuit 97 determines that the plurality of the sheets P is in the overloading state. If the processing in Act 17 is terminated, the processing in Act 21 is executed.

In Act 21, the sheet feed and conveyance control circuit 97 sends the control signal to the input and output control circuit 96 through the system controller 92. If the input and output control circuit 96 enables the display section 14*b* to perform the display, a message "The sheet is in the overloading state. Please reduce the number of the sheets." is displayed in the warning display area of the display section 14*b*. If the processing in Act 21 is terminated, the processing in Act 23 is executed.

Based on the display in Act 19 or Act 21, the operator detaches the sheet feed cassette 18A from the main body 11. At this time, the tray sheet metal 21A is lowered to the predetermined position.

After Act 19, the plurality of the sheets P is taken out from the sheet feed cassette 18A by the user. The curls of the plurality of the sheets P are corrected and then the plurality of the sheets P is returned into the sheet feed cassette 18A by the user. After Act 21, the number of the sheet P accommodated in the sheet feed cassette 18A is reduced. The sheet feed cassette 18A is attached to the main body 11. At this time, as described above, the tray sheet metal 21A rises so that the pickup roller 38A comes into contact with the upper surface of the uppermost sheet of the plurality of the sheets P.

In Act 23, the sheet feed and conveyance control circuit 97 determines whether or not the side optical sensor 23A detects the plurality of the sheets P. If the side optical sensor 23A does not detect the plurality of the sheets P (No in Act 23), the processing in Act 25 is executed. On the other hand, if the side optical sensor 23A detects the plurality of the sheets P (Yes in Act 23), the processing in Act 23 is executed again.

In Act 25, the sheet feed and conveyance control circuit 97 erases the display in the warning display area of the display section 14*b* via the system controller 92 and the input and output control circuit 96. If the processing in Act 25 is terminated, all steps in Act 1 are ended and the processing in Act 31 is executed.

In Act 31, the image processing apparatus 1 reads the image on the original document.

For example, the reading of the image data may be performed by enabling the scanner section 15 to read the original document. In this case, the operator places the original document on the document table 12 or the ADF 13. Thereafter, the operator performs an operation input for starting the scanning of the scanner section 15 through the operation section 14*a*. The image data read by the scanner section 15 is stored in the RAM 94 through the I/F 95.

After the image data is read, the processing in Act 31 is terminated and the processing in Act 33 is executed.

In Act 33, the operator selects which one of the sheets P accommodated in the sheet feed cassettes 18A and 18B and the manual sheet feed unit 19 to use by operating the operation section 14*a*. In this example, it is assumed that the sheet P accommodated in the sheet feed cassette 18A is selected.

After the sheet P is selected, the processing in Act 33 is terminated and the processing in Act 35 is executed.

In Act 35, the operator inputs an instruction to start printing by operating the operation section 14*a*.

The system controller 92 sends a control signal to the fixing control circuit 99 to start a warm-up operation of the fixing section 81. The fixing control circuit 99 starts the warm-up operation of the fixing section 81 and lights the halogen lamp. If the warm-up operation is terminated, the fixing control circuit 99 sends a conveyance permission signal of the sheet P to the system controller 92.

After the warm-up operation is ended, the processing in Act 35 is ended and the processing in Act 37 is executed.

In Act 37, the sheet P selected in Act 33 is fed to the downstream side. Specifically, the system controller 92 sends a control signal to start feeding the sheet P to the sheet feed and conveyance control circuit 97. The sheet feed and conveyance control circuit 97 controls feeding of the sheet P from the selected sheet feed cassette 18A based on the control signal from the system controller 92. The sheet P stops with the tip of the sheet P abutting against the registration roller 76 at the registration position a.

Through the above, the processing in Act 37 is terminated and the processing in Act 39 is executed.

In Act 39, the formation of a toner image on the intermediate transfer belt 53 is started. Specifically, the system controller 92 determines whether the conveyance permission signal is received from the fixing control circuit 99. If the conveyance permission signal is received, the system controller 92 sends a control signal to start forming a toner image to the sheet feed and conveyance control circuit 97, the image forming control circuit 98, and the fixing control circuit 99.

The sheet feed and conveyance control circuit 97, the image forming control circuit 98, and the fixing control circuit 99 start controlling the operation respectively in parallel.

Through the above, the processing in Act 39 is terminated and the processing in Act 41 is executed.

The image forming control circuit 98 starts the image forming processes of the image forming sections 51Y, 51M, 51C and 51K in this order. In each of the image forming sections 51Y, 51M, 51C and 51K, an electrostatic latent image is written on the surfaces of the photoconductive drums 56Y, 56M, 56C and 56K by exposure light $L_Y$, $L_M$, $L_C$ and $L_K$ from the exposure device 52. Each electrostatic latent image is developed by the developing devices 58Y, 58M, 58C and 58K.

The developed toner image is transferred onto the intermediate transfer belt 53 by the primary transfer rollers 59Y, 59M, 59C and 59K. The toner image forming areas are overlapped by each primary transfer. Each of the toner images stacked on the intermediate transfer belt 53 is conveyed towards the secondary transfer position b by the intermediate transfer belt 53.

In parallel with the operation of the image forming control circuit 98, the processing in Act 41 is executed. In Act 41, at a timing at which the toner image reaches a predetermined position, the driving motor 97*a* for driving the registration roller 76 is driven by the sheet feed and conveyance control circuit 97. The rotation of the registration roller 76 is started by the driving motor 97*a*. The timing to start the rotation of the registration roller 76 is a timing at which the tip of the transfer area of the toner image on the sheet P reaches the secondary transfer position b if the tip of the toner image reaches the secondary transfer position b.

Through the above, the processing in Act 41 is terminated and the processing in Act 43 is executed.

In Act 43, the toner image on the intermediate transfer belt 53 is transferred onto the sheet P. Specifically, the sheet feed and conveyance control circuit 97 rotates the driving roller 69 at a predetermined linear velocity. The image forming control circuit 98 applies the secondary transfer voltage to the secondary transfer roller 71 until the tip of the sheet P reaches the secondary transfer position b. The toner image is transferred onto the sheet P passing through the secondary transfer position b. The sheet P that passes through the secondary transfer position b is conveyed along the conveyance path towards the fixing section 81.

The image forming control circuit 98 stops applying the secondary transfer voltage after a rear end of the sheet P passes through the secondary transfer position b. Through the above, the processing in Act 43 is executed.

If the sheet P passing through the secondary transfer position b enters the fixing section 81, the processing in Act 45 is executed. In Act 45, the toner image is fixed on the sheet P by the fixing section 81.

Through the above, the processing in Act 45 is terminated and the processing in Act 47 is executed.

In Act 47, the sheet P is discharged. The sheet P discharged from the fixing section 81 reaches the conveyance roller 82. The conveyance roller 82 discharges the sheet P to the sheet discharge section 83.

Through the above, the image formation on one sheet P is terminated.

The processing in Act 1 may be executed at any timing during printing of the image processing apparatus 1. At that time, the printing processing is interrupted.

In the conventional sheet feed cassette, there is a problem that the sheet P is easily jammed in the conveyance path if the plurality of the sheets P is curved or in the overloading state.

On the other hand, the sheet feed cassette 18A of the present embodiment has the side optical sensor 23A provided in the side guide 22A. Therefore, it is possible to detect the accommodation state of the plurality of the sheets P accommodated in the housing section 20*a*A. By recognizing the detection result, the operator can correct the curving of the plurality of the sheets P and reduce the number of sheets.

The side optical sensor 23A is provided at the downstream side end of the side guide 22A in the sheet feeding direction X1 of the side guide 22A. Therefore, it is possible to detect the curved state at the position close to the conveyance path in the plurality of the sheets P, and determine whether or not the plural curved sheets P are jammed in the conveyance path more accurately.

The side optical sensor 23A is a reflective sensor. This makes it possible to reliably detect the end facing the side optical sensor 23A in the direction Y of the sheet P.

The side optical sensor 23A is provided in each of the pair of the side guides 22A. Therefore, the curved state at each end of the direction Y of the sheet P can be detected.

The sheet feed cassette 18A includes the end guide 24A and the end optical sensor 25A. This makes it possible to detect a state in which the plurality of the sheets P is curved to be convex upward in the direction Y.

Furthermore, according to the image processing apparatus 1 of the present embodiment, the image processing apparatus 1 can be constituted using the sheet feed cassette 18A capable of detecting the accommodation state of the plurality of the sheets P.

By performing the display at the time the side optical sensor 23A detects the plural sheets P, the operator can recognize the accommodation state of the sheet P.

The image processing apparatus 1 includes the tray sheet metal 21A, the pickup roller 38A, the roller moving section 39A, the tray moving section 102A, and the roller sensor 104A. Therefore, depending on whether the position of the roller is lower than the third height threshold value H3, it is possible to determine whether the plurality of the sheets is curved or overloaded.

The sheet feed cassette 18A of the present embodiment can be variously modified as described below.

Figure 15:
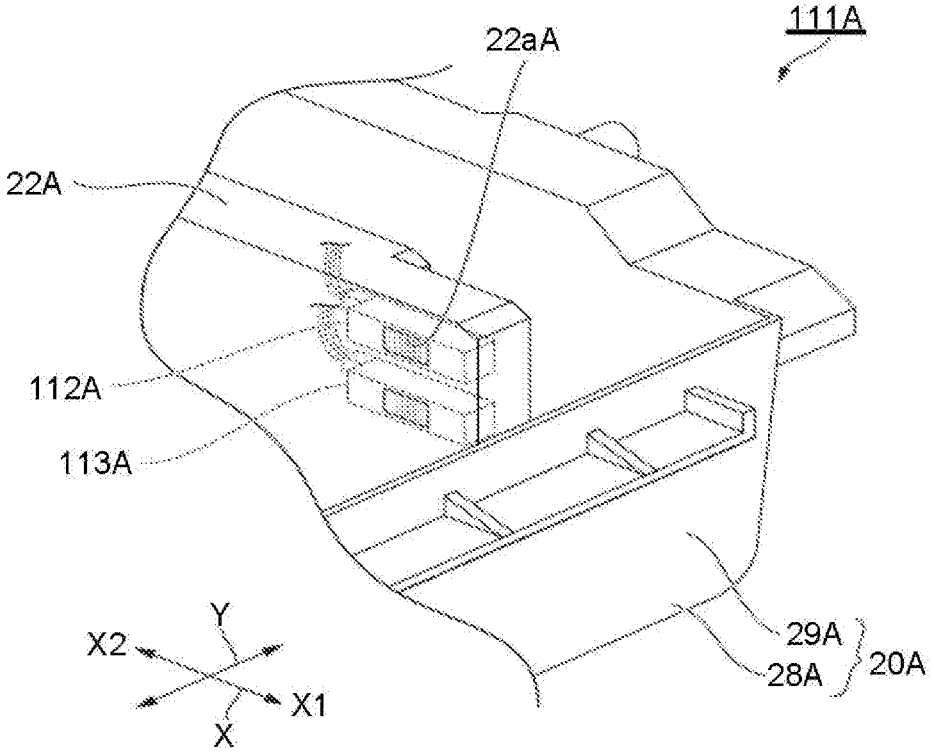
FIGS. 15-16 are each a perspective view of the main portions of a sheet feed cassette in an image processing apparatus according to a modification of the embodiment.

The sheet feed cassette 111A shown in FIG. 15 includes a side upper optical sensor (first upper optical sensor) 112A and a side lower optical sensor (first lower optical sensor) 113A as first optical sensors instead of the side optical sensor 23A in the side guide 22A. The optical sensors 112A and 113A are constituted similarly to the side optical sensor 23A.

The side lower optical sensor 113A is located below the side upper optical sensor 112A. The optical sensors 112A and 113A are electrically connected to the sheet feed and conveyance control circuit 97. The detectable area of the sheet P by the side lower optical sensor 113A and the detectable area of the sheet P by the side upper optical sensor 112A are shifted in the vertical direction.

According to the sheet feed cassette 111A of the modification, it is possible to switch the height at which the plurality of the sheets P is detected according to the type such as the thickness of the sheet P. For example, as the sheet P becomes thick, the conveyance path tends to become clogged, and thus, the detection is made using the side lower optical sensor 113A located at the lower position.

Figure 16:
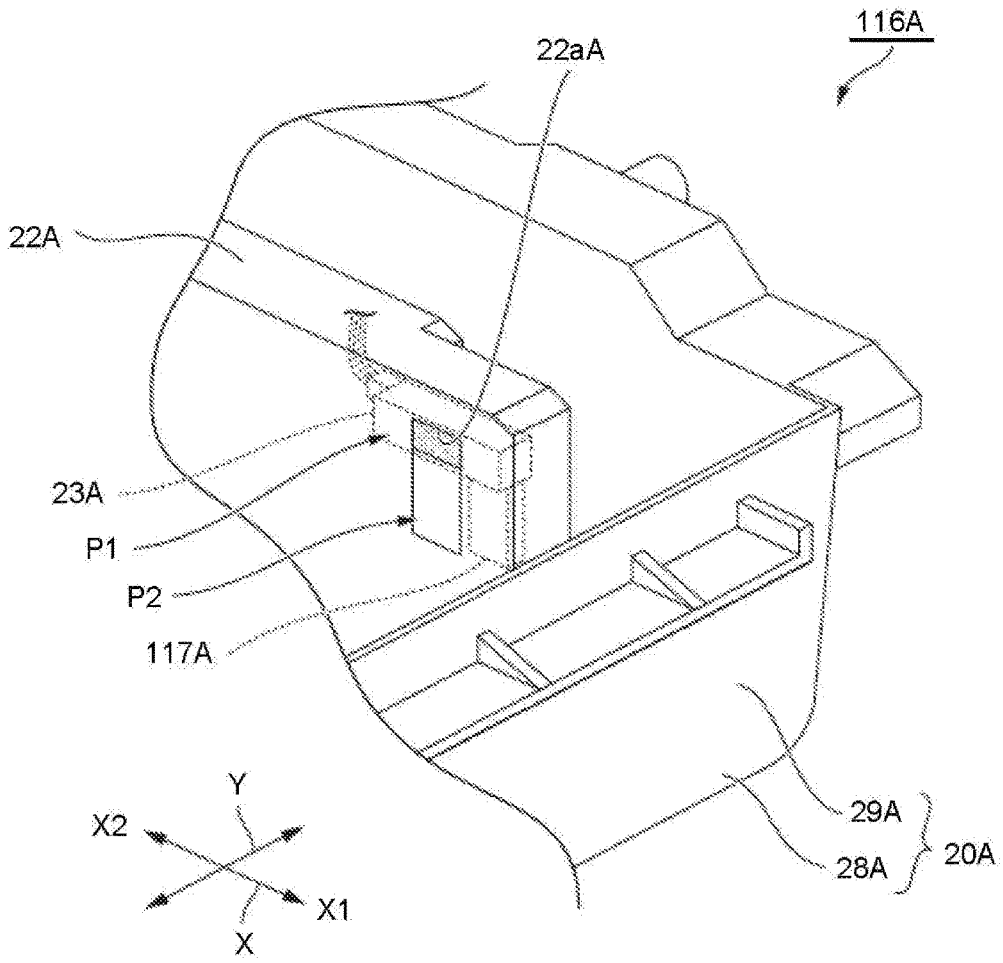

A sheet feed cassette 116A shown in FIG. 16 has a sensor moving section 117A in addition to each component of the sheet feed cassette 18A. For example, the sensor moving section 117A has a guide rail and a driving motor. The guide rail extends along the vertical direction and is attached to the side guide 22A. The driving motor is movable along the guide rail and fixed to the side optical sensor 23A. In this case, it is preferable that a window hole 22*a*A is formed in a long hole shape extending along the vertical direction. If the driving motor is driven, the sensor moving section 117A can move the side optical sensor 23A to a first position P1 and a second position P2 below the first position P1.

According to the sheet feed cassette 116A of the modification, the same effect as that of the sheet feed cassette 111A of the modification can be obtained.

Figure 17:
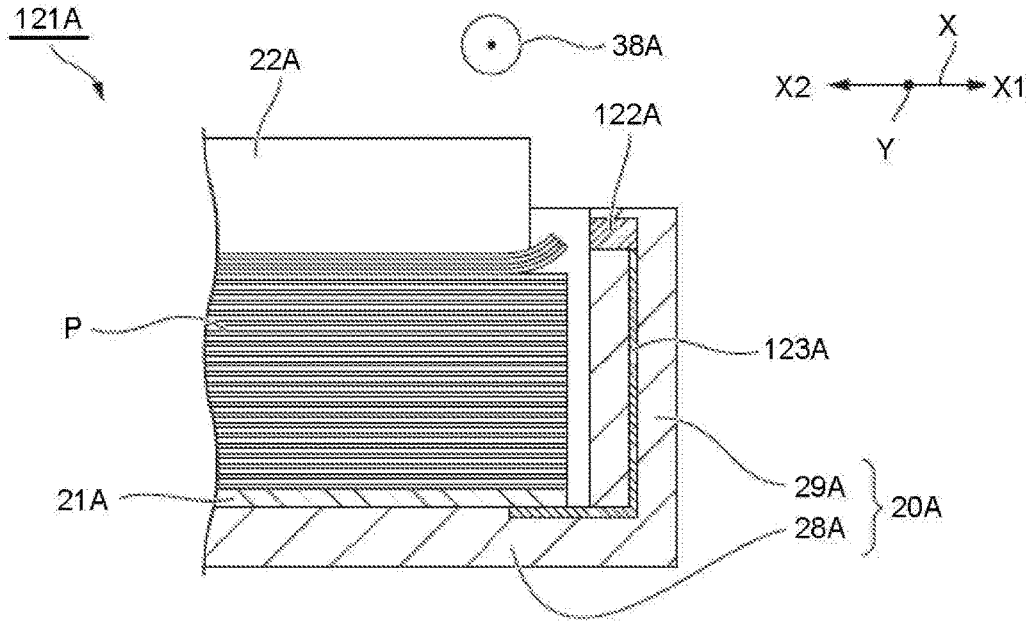
FIG. 17 is a schematic cross-sectional view illustrating a front view of the sheet feed cassette in the image processing apparatus according to the modification of the embodiment.

The sheet feed cassette 121A shown in FIG. 17 is provided with a front optical sensor 122A provided at the side wall 29A of the downstream side end in the sheet feeding direction X1 of the cassette tray 20A instead of the side optical sensor 23A. The front optical sensor 122A is constituted similarly to the side optical sensor 23A. The side guide 22A and the front optical sensor 122A are connected by a connecting member 123A. The side guide 22A and the front optical sensor 122A integrally move in the direction Y.

According to the sheet feed cassette 121A of the modification, it is possible to detect the accommodation state of the end of the downstream side end in the sheet feeding direction X1 of the plurality of the sheets P.

The position where the side optical sensor 23A is provided may be the center part in the sheet feeding direction X of the side guide 22A. Although the side optical sensor 23A is assumed to be a diffuse reflective sensor, the side optical sensor 23A may be a retroreflective sensor, a transmissive optical sensor, or the like.

The sheet feed cassette 18A may not have the end optical sensor 25A. The image processing apparatus 1 may not include the display section 14*b*, the roller moving section 39A, the roller sensor 104A.

According to at least one embodiment described above, by having the side optical sensor 23A, it is possible to detect the accommodation state of the plurality of the sheets P.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet feed apparatus, comprising:

a tray having a housing to accommodate a plurality of sheets;

a pair of first guides arranged in the tray and configured to sandwich the sheets in a direction perpendicular to a sheet conveyance direction; and a first optical sensor provided above a bottom of the housing in at least one of the first guides, and configured to detect one or more of uppermost sheets accommodated in the housing, the first optical sensor being mounted for movement between a first position and a second position below the first position.

2. The sheet feed apparatus according to claim 1, wherein the first optical sensor is provided at an end of the at least one of the first guides in the sheet conveyance direction.

3. The sheet feed apparatus according to claim 2, wherein the first optical sensor is a reflective sensor having a light emitter that emits light and a light detector positioned to detect the light reflected by the sheets.

4. The sheet feed apparatus according to claim 3, wherein the first optical sensor is provided in both of the first guides.

5. The sheet feed apparatus according to claim 1, further comprising:

a second guide arranged in the tray to support an end of the sheets at an upstream side of the sheets in the sheet conveyance direction; and a second optical sensor arranged in the second guide section and configured to detect the end of the sheets at the upstream side in the sheet conveyance direction.

6. The sheet feed apparatus according to claim 1, wherein the first optical sensor includes a first upper optical sensor and a first lower optical sensor arranged below the first upper optical sensor.

7. An image processing apparatus, comprising:

a main body; and a sheet feed apparatus detachably attached to the main body, wherein the sheet feed apparatus, comprises:

a tray having a housing to accommodate a plurality of sheets;

a pair of first guides arranged in the tray and configured to sandwich the sheets in a direction perpendicular to a sheet conveyance direction; and a first optical sensor provided above a bottom of the housing in at least one of the first guides, and configured to detect one or more of uppermost sheets accommodated in the housing;

a display; and a controller configured to control the display based on a detection result of the first optical sensor, wherein the controller controls the display to display an error message if the first optical sensor detects the one or more of the uppermost sheets.

8. The image processing apparatus according to claim 7, wherein the sheet feed apparatus includes a support provided in the housing of the tray and configured to support the sheets on an upper surface thereof and be movable in a vertical direction with respect to the tray.

9. The image processing apparatus according to claim 8, wherein the sheet feed apparatus further comprises:

a roller provided in the main body and movable in the vertical direction with respect to the main body, a roller moving section configured to move the roller, a roller detection section configured to detect a position of the roller, and a support moving section configured to move the support, and wherein the image processing apparatus further comprises a second controller configured to control the roller moving section and the support moving section based on the detection results of the first optical sensor and the roller detecting section.

10. The image processing apparatus according to claim 9, wherein the second controller drives the support moving section to raise the upper surface of the sheet to a first predetermined reference height and drives the roller moving section to place the roller on the sheet if the sheet feed apparatus is attached to the main body.

11. The image processing apparatus according to claim 9, wherein at the time the first optical sensor detects the sheet after the roller is placed on the sheet, the second controller determines that the sheet is curved if the roller detection section detects that the position of the roller is lower than a predetermined second reference height.

12. The image processing apparatus according to claim 9, wherein the second controller determines that the sheets with the number thereof equal to or larger than an allowable number of sheets are stored in the housing section if the roller detection section detects that the position of the roller is equal to or higher than the second reference height.

13. An image processing apparatus, comprising:

a main body; and a sheet feed apparatus detachably attached to the main body, wherein the sheet feed apparatus, comprises:

a tray having a housing to accommodate a plurality of sheets;

a pair of first guides arranged in the tray, and configured to sandwich the sheets in a direction perpendicular to a sheet conveyance direction; and a first optical sensor provided above a bottom of the housing in at least one of the first guides, and configured to detect one or more of uppermost sheets accommodated in the housing, the first optical sensor being mounted for movement between a first position and a second position below the first position.

14. The image processing apparatus according to claim 13, further comprising:

a display; and a controller configured to control the display based on a detection result of the first optical sensor, wherein the controller controls the display to display an error message if the first optical sensor detects the one or more of the uppermost sheets.

15. The image processing apparatus according to claim 13, wherein the sheet feed apparatus includes a support provided in the housing of the tray and configured to support the sheets on an upper surface thereof and be movable in a vertical direction with respect to the tray.

16. The image processing apparatus according to claim 15, wherein the sheet feed apparatus further comprises:

a roller provided in the main body and movable in the vertical direction with respect to the main body, a roller moving section configured to move the roller, a roller detection section configured to detect a position of the roller, and a support moving section configured to move the support, and wherein the image processing apparatus further comprises a second controller configured to control the roller moving section and the support moving section based on the detection results of the first optical sensor and the roller detecting section.

17. The image processing apparatus according to claim 16, wherein the second controller drives the support moving section to raise the upper surface of the sheet to a first predetermined reference height and drives the roller moving section to place the roller on the sheet if the sheet feed apparatus is attached to the main body.

18. The image processing apparatus according to claim 16, wherein at the time the first optical sensor detects the sheet after the roller is placed on the sheet, the second controller determines that the sheet is curved if the roller detection section detects that the position of the roller is lower than a predetermined second reference height.

19. The image processing apparatus according to claim 16, wherein the second controller determines that the sheets with the number thereof equal to or larger than an allowable number of sheets are stored in the housing section if the roller detection section detects that the position of the roller is equal to or higher than the second reference height.

* * * * *